United States Patent [19]

Van Hoesen et al.

[11] 4,375,364

[45] Mar. 1, 1983

[54] RIGID DISCHARGE ELECTRODE FOR ELECTRICAL PRECIPITATORS

[75] Inventors: Harold E. Van Hoesen, Neshanic Station; Jakoplic, Richard, Somerset, both of N.J.

[73] Assignee: Research-Cottrell, Inc., Somerville, N.J.

[21] Appl. No.: 313,223

[22] Filed: Oct. 20, 1981

Related U.S. Application Data

[63] Continuation of Ser. No. 179,981, Aug. 21, 1980, abandoned, and Ser. No. 903,837, May 8, 1978, abandoned.

[51] Int. Cl.[3] ..... B03C 3/47

[52] U.S. Cl. ..... 55/152; 29/591; 55/145; 55/150; 361/226; 361/230

[58] Field of Search ..... 55/112, 130, 145, 150–153; 29/591, 592 R; 361/225, 226, 230

[56] References Cited

U.S. PATENT DOCUMENTS

| | | | |
|---|---|---|---|
| 804,291 | 11/1905 | Wood | 55/150 |
| 1,798,511 | 3/1931 | Wintermute et al. | 55/145 |
| 2,448,407 | 8/1948 | Antalek | 55/152 |
| 3,158,453 | 11/1964 | Maartman et al. | 55/112 |
| 3,553,939 | 1/1971 | Dyla | 55/130 X |
| 3,570,219 | 3/1971 | Schmitz | 55/151 X |
| 3,616,608 | 11/1971 | Stevernagel et al. | 55/150 X |
| 3,660,968 | 5/1972 | Dyla et al. | 55/150 X |
| 3,892,544 | 7/1975 | Haupt | 55/150 X |

FOREIGN PATENT DOCUMENTS

| | | | |
|---|---|---|---|
| 401997 | 7/1967 | Australia | 55/152 |
| 1158044 | 11/1963 | Fed. Rep. of Germany | 55/150 |
| 18357 | of 1915 | United Kingdom | 55/152 |
| 840853 | 7/1960 | United Kingdom | 55/150 |

*Primary Examiner*—Richard L. Chiesa

*Attorney, Agent, or Firm*—Kerkam, Stowell, Kondracki & Clarke

[57] ABSTRACT

A discharge electrode and discharge electrode assembly having longer more reliable service life than conventional tensioned wires wherein the electrode is categorized as rigid because its mechanical behavior more closely resembles that of a structural beam than a wire of equal length and the electrode in the preferred embodiment has a flattened ellipsoidal configuration with corona members projecting substantially along a plane passing through the long axis of the ellipsoidal electrode.

7 Claims, 21 Drawing Figures

3
42
10
40
38
44
38
12
52
46
48
36
20
36
14
16
50
2
2
26
62
60
56
58
3
18

20
22
46
20
22
22

100
12
12
106
104
104
102

14
14
120
112
118

16
16
128
128
126
126
122
124

100
106
106
102
110

114
112
116

128
126
126
128
124

RIGID DISCHARGE ELECTRODE FOR ELECTRICAL PRECIPITATORS

This application is a continuation of application Ser. No. 179,981, filed Aug. 21, 1980, and Ser. No. 903,837 filed May 8, 1978, both now abandoned.

BACKGROUND OF THE INVENTION

1. Field of the Invention

This invention is directed to an improved discharge electrode and electrode assembly for electrical precipitators which inherently maintains a high degree of straightness and resistance to deflection, structural failure and an improved electrical field over known prior art.

2. Description of the Prior Art

For many years, the basic discharge electrode system for electrostatic precipitators consisted of flexible wires hung vertically downwardly from an upper high voltage structure of the precipitator which wire-discharge electrodes were provided with tensioning weights at their lower ends. Such wire-discharge electrodes have produced electrical field conditions in the gas passage conducive to particulate removal. However, the critical dependence of electrical precipitator operation on the structural integrity of individual discharge electrode wires has been a dominant factor in developing substitutes for such flexible wires which would insure the market demand for continuous precipitator operation at high efficiency to meet environmental protection measures.

It is, therefore, a primary object of the present invention to provide a discharge electrode system which has better electrical properties than prior art fine-wire electrodes and has improved, more reliable service life than tensioned wires, and such a system amenable to mass production and which would be compatible with existing precipitator installations whereby the improved discharge electrode system could be employed as a replacement for conventional fine-wire discharge systems with a minimum of expense and chageover down time.

SUMMARY OF THE INVENTION

The present invention may be summarized as an electrostatic precipitator comprising a housing having a dirty gas inlet and a clean gas outlet, a plurality of spaced parallel extended surface collecting electrodes, means rigidly supporting the collecting electrodes in the gas-flow path through the housing, a discharge electrode system in the housing in precipitating alignment to the collecting electrodes, the discharge electrode system comprising a horizontal, top-conductive beam rigidly connected to the precipitator high voltage frame, a plurality of rigid discharge electrodes, each such discharge electrode comprising a hollow support member, corona members carried by the support member, and upper and lower termination members secured to the upper and lower ends of the hollow support member, means connecting the upper termination member to the top conductive beam, a lower frame, means connecting each lower termination to the lower frame, and rigid electrical insulating members connecting the lower frame to the support members for the collecting electrodes. The invention further comprises a discharge electrode having a flattened ellipsoidal configuration in cross-section and corona members projecting outwardly of the electrode in a plane passing through the larger diameter of the ellipsoid.

The invention will be more particularly described in reference to the accompanying drawings.

DESCRIPTION OF THE PREFERRED EMBODIMENTS

Figure 1:
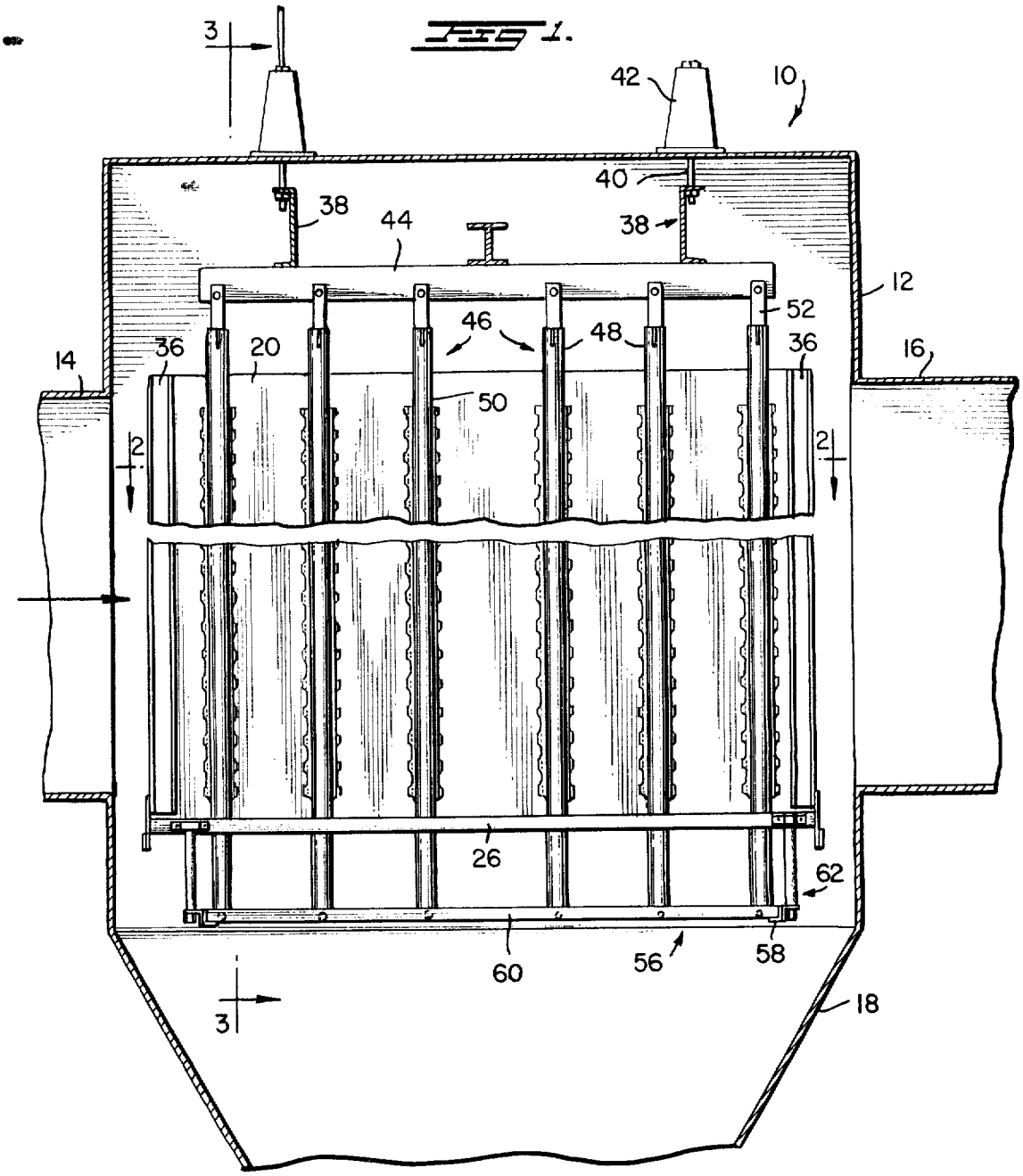
FIG. 1 is an enlarged fragmentary detailed view of an electrostatic precipitator including the inventive concepts hereof.
Figure 2:
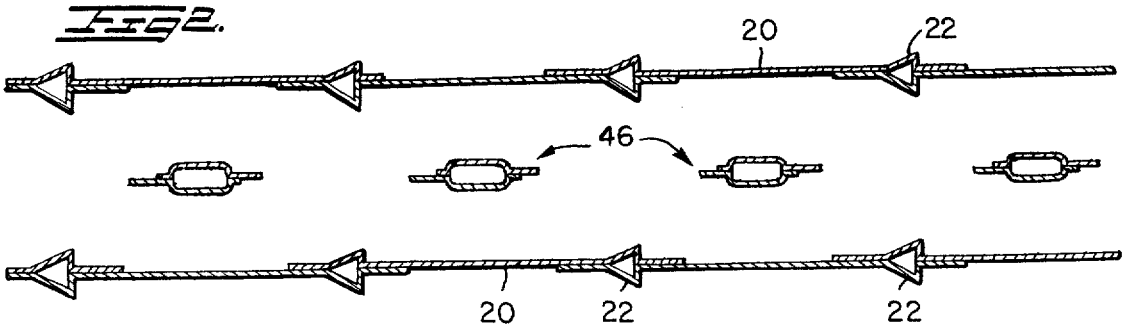
FIG. 2 is a section on line 2—2 of FIG. 1.
Figure 3:
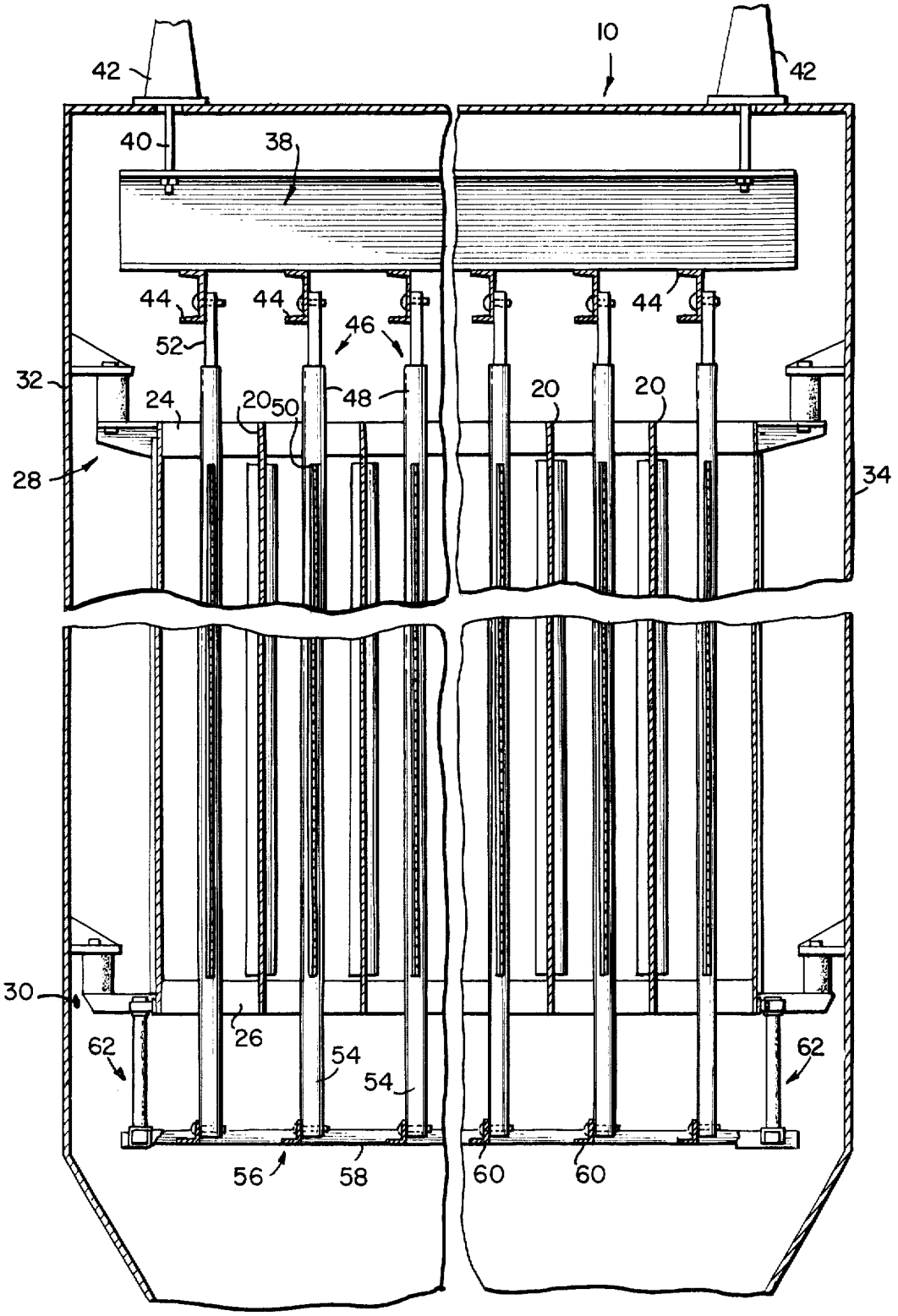
FIG. 3 is a section on line 3—3 of FIG. 1.

Referring particularly to FIGS. 1 through 10, 10 generally designates an electrostatic precipitator having a housing 12 and a gas inlet 14 and gas oulet 16 from the housing.

At the lower end of the housing 12, a conventional dust-receiving hopper is illustrated at 18. Gas flow through the housing is illustrated by the directional arrow, FIG. 1 of the drawing. Interiorly of the housing are a plurality of spaced, vertically arranged, parallel collecting plates. The plates 20 in the illustrated form of the invention are of the type having plate-rigidifying baffle elements 22 extending vertically from top to bottom at predetermined space intervals thereacross. The plural plates are supported by a grounded plate support assembly comprising a top beam 24, a lower beam 26, and hanger members generally designated 28 and 30 which connect the upper and lower beams 24 and 26 to the side walls 32 and 34 of the precipitator housing. Additional stiffening means such as illustrated at 36, FIG. 1, may be provided along the leading and trailing edge of the plural collecting plates 20. Above the collecting plates is mounted a conventional high-tension electrode support frame generally designated 38 which support frame is carried by the precipitator housing via tie-rods 40 and insulators 42. One or more of the tie-rods 40 provides lead-in for high voltage electricity for energizing the discharge electrodes. The plural high-tension support members 38 have secured along their lower edges, a plurality of discharge electrode support beams 44. Suspended from the support beams 44 are the discharge electrodes 46. Each of the novel discharge electrodes 46 comprises a tubular support member 48. The tubular support is of flattened ellipsoidal configuration as to be more fully described in reference to FIGS. 6 through 10 and 21.

Corona producing members 50 are formed with the support member 48 and extend outwardly along and in the plane of the larger diameter of the support member. The electrode also includes at least an upper termination portion 52; all to be assembled as hereinafter to be detailed.

The lower termination portion 54, which may be a portion of the support member 48, without the corona-producing members 50 are fastened to lower electrode stabilizing frame means generally designated 56. Frame means 56 consist of transverse beams 58 and cross beams 60 which are parallel to the flow of gas through the precipitator. The beams 60 are welded or otherwise secured to the beams 58 and the terminal ends 54 of each of the rigid discharge electrodes 46 is pin connected to the beams 60 as to be detailed hereinafter.

In order to stabilize the lower frame for the rigid discharge electrodes, said frames are connected to the framing for the lower ends of the collecting plates 20 by means 62.

Figure 4:
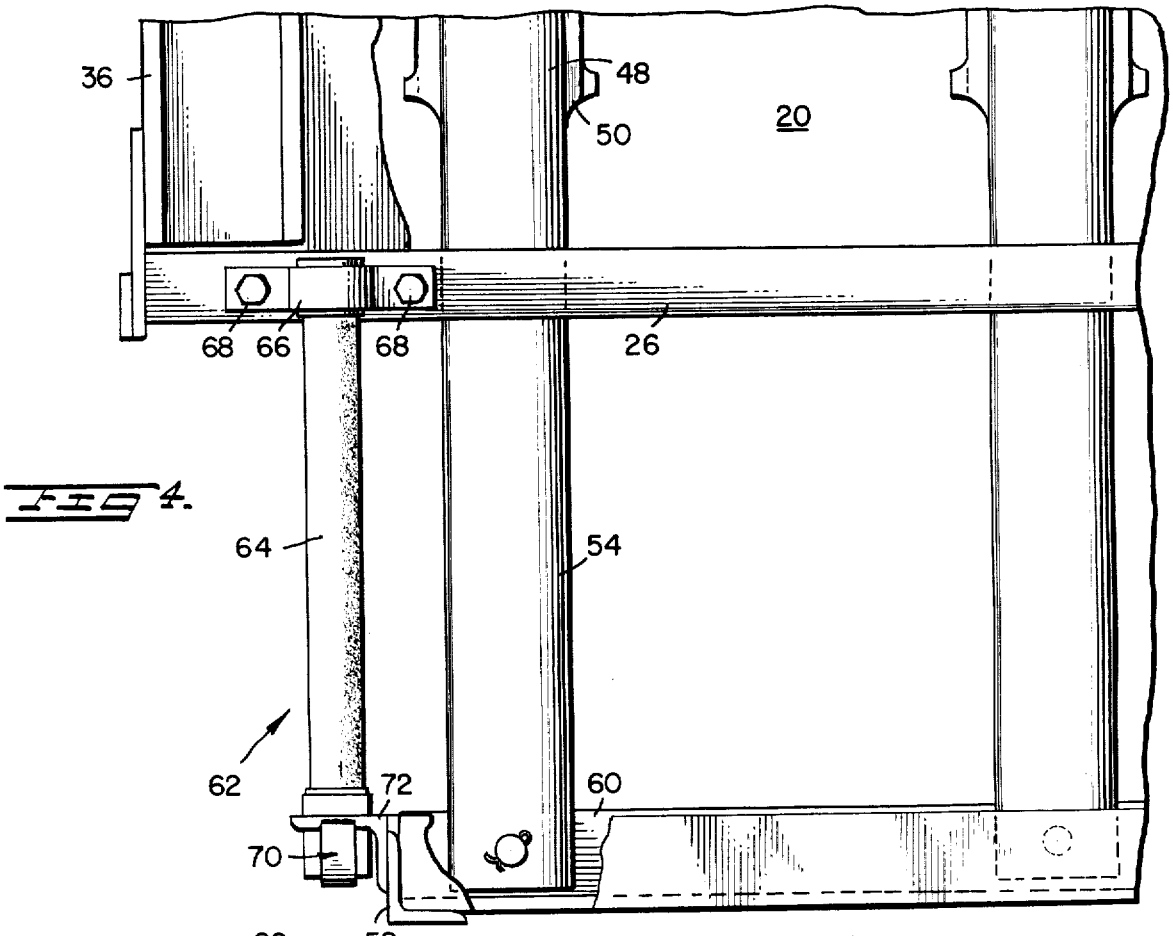
FIG. 4 is an enlarged fragmentary detailed view of connecting means between the discharge electrode lower frame and the collecting electrodes.
Figure 5:
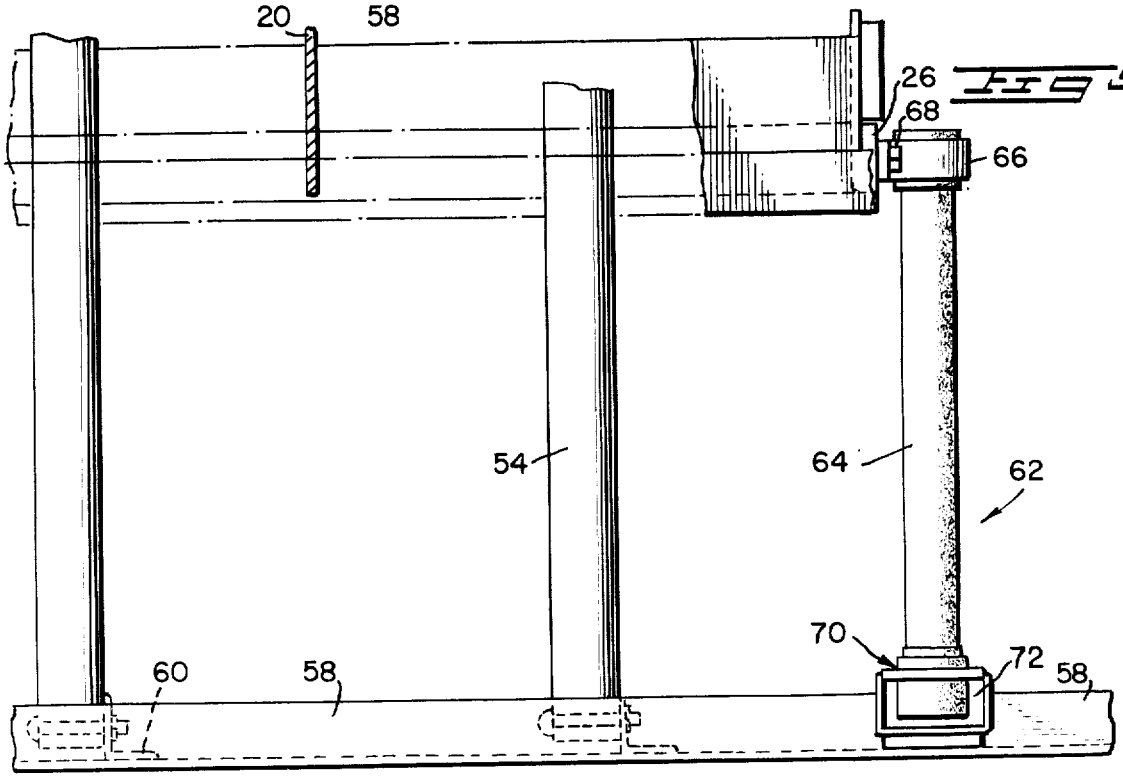
FIG. 5 is a view like FIG. 4 viewed 90 degrees from that shown in FIG. 4.
Figure 6:
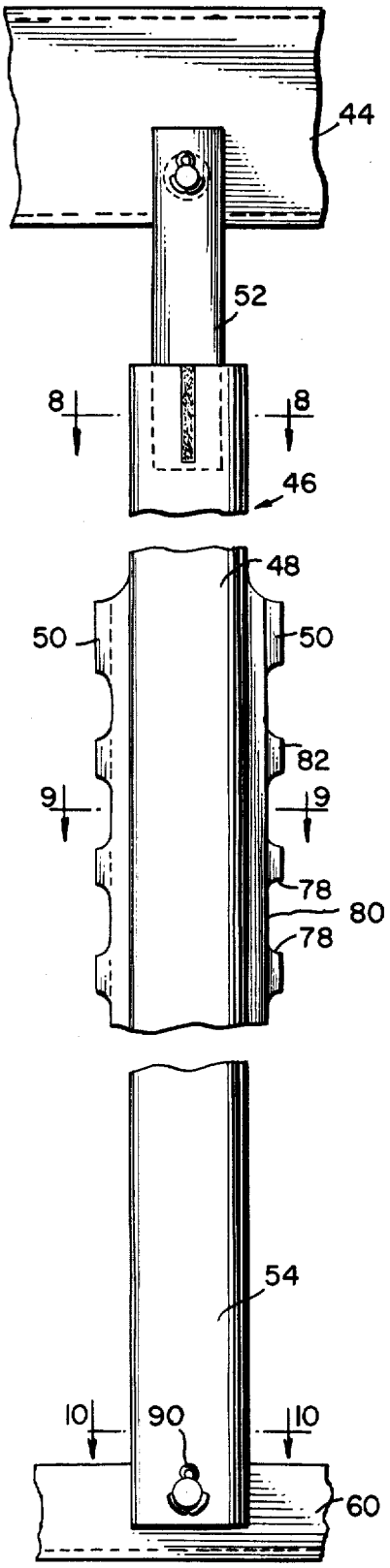
FIG. 6 is an enlarged fragmentary detailed view of one of the discharge electrodes of the present invention.
Figure 7:
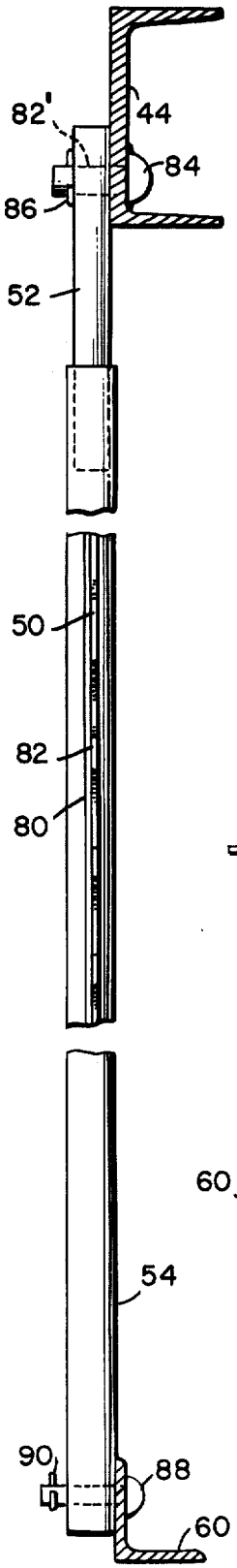
FIG. 7 is a view of the assembly in FIG. 6 viewed 90 degrees therefrom.

Referring now to FIGS. 4 and 5, the connecting means between the frames at the lower ends of the rigid discharge electrodes and the frame at the lower ends of the collecting electrodes will be described.

The connecting means as detailed in FIGS. 4 and 5 of the drawings basically comprise an insulating rod 64. The insulating rod 64 is clamped by a rod clamp 66, bolted as at 68 to the cross frame 26 of the collecting electrode assembly. The lower end of the insulator 64 is carried in a strap-formed pocket generally designated 70, which pocket is connected to a weldment 72, secured to cross-frame 58. With one of the insulator connector assemblies 62 at each corner of the framing 56, the discharge electrodes 46 are maintained in parallel-spaced relationship to their associated collecting plate electrodes 20.

The four corner stabilizers have been found to be adequate for assemblies having widths of approximately 20 feet. If spans are greater than 20 feet, additional stabilizing insulator assemblies 62 should be installed.

Referring now to FIGS. 6 through 10, there is detailed a method of constructing the improved rigid discharge electrode 46 and the means for attaching the terminal portions thereof to the upper and lower supporting frames 44 and 60. In this preferred embodiment of the invention, the electrode is constructed such that the support member 48 is configured, in cross-section, as a somewhat flattened tube or flattened ellipsoid. The element 48 and the corona-producing members 50 are formed from a pair of sheet elements 76 which are formed and then welded one to the other. In forming the sheet members 76, the corona-producing portions 50 are configured as a plurality of notched portions 78 interconnected by a straight portion 80, with the notched portions being in the order of about two inches in length and the webs 82 therebetween having a length of about one inch.

For an electrostatic precipitator having collecting plates spaced twelve inches to provide twelve inch gas passage flattened ellipsoidal discharge electrodes having a minor axis of 1¼ inches and a major axis of 3½ inches with the discharge tips being spaced 5½ inches, have proved to be very satisfactory. For an assembly having collecting plates spaced nine inches to provide gas passages of nine inches, a similar size electrode could be used.

Figure 8:
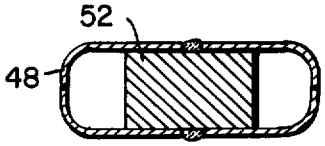
FIG. 8 is a section on line 8—8 of FIG. 6.
Figure 9:
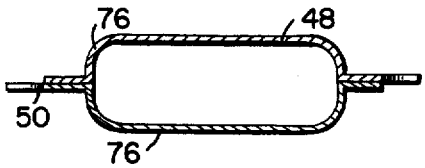
FIG. 9 is a section on line 9—9 of FIG. 6.
Figure 10:
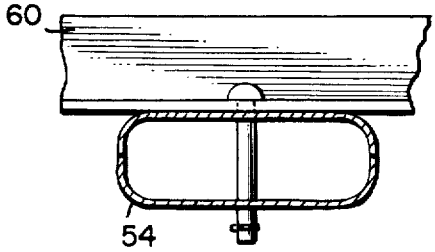
FIG. 10 is a section on line 10—10 of FIG. 6.

The upper terminals 52 are formed of solid stock as more clearly shown in FIG. 8 and are welded into the upper end of the support portion 48 of the electrode. The terminal portions 52 are bored as at 82' and a pin 84 passes through a complementary bore in beam 44 and the pins are retained in the illustrated positions by cotter keys 86. This form of assembly has built-in self-aligning features and permits installation of rigid-type discharge electrodes as replacements for conventional wire and weight electrodes with a minimum of on-the-site labor. Similarly, the lower terminal portions 54 of the electrodes are bored complementary to bores in lower frame portions 60 and a pin 88 is cotter keyed as at 90 to complete the assembly. The particular electrode illustrated in FIGS. 6 through 10 has proved to be very satisfactory in operation.

Figure 20:
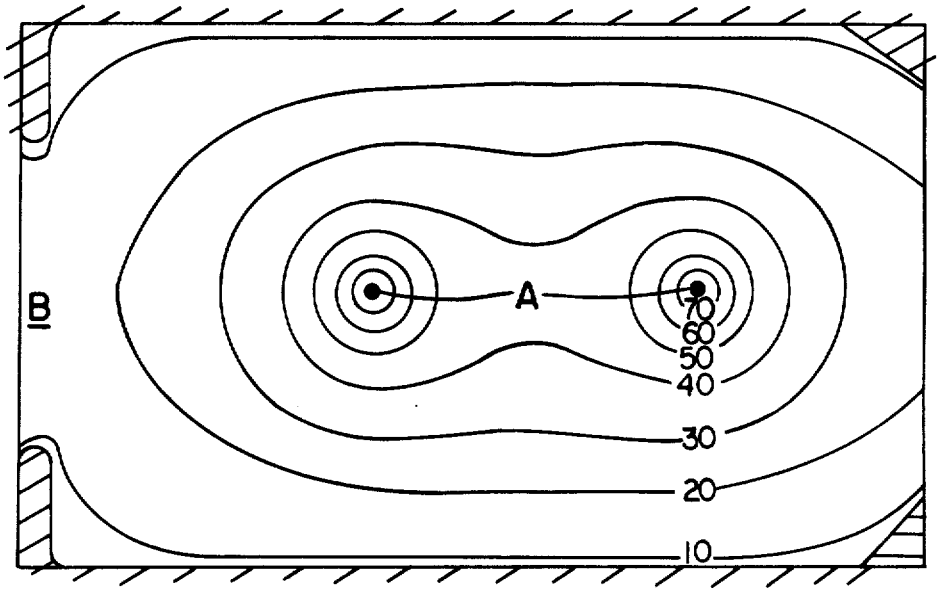
FIG. 20 is a field plot of equipotential lines for 0.109 wire discharge electrodes.
Figure 21:
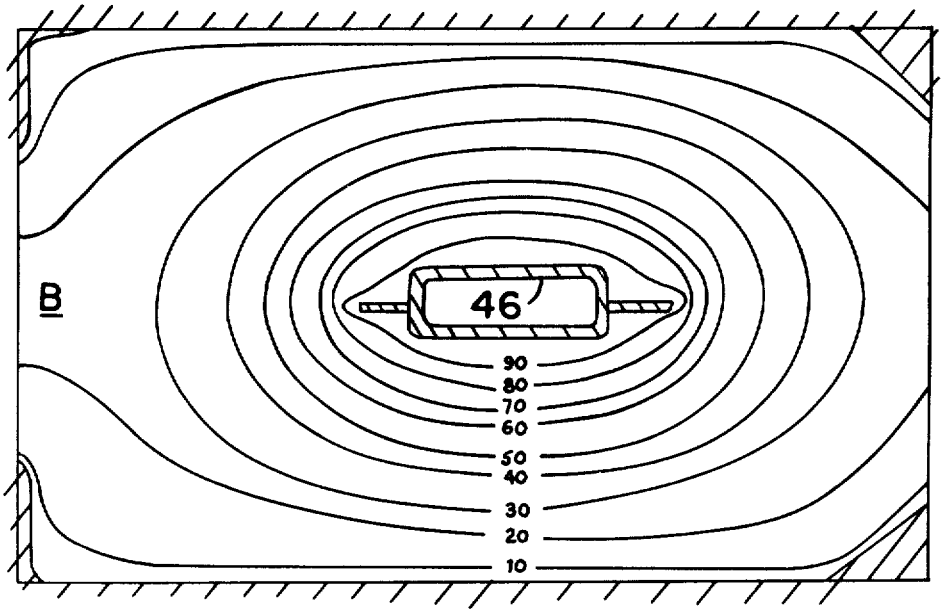
FIG. 21 is a plot like that shown in FIG. 20 employing the electrode shown in FIGS. 6–10.

FIGS. 20 and 21 show analog plots of electrostatic fields for two 0.109" wires designated A and the flattened ellipsoidal electrode 46 of this invention in a 9" opzel collecting electrode passage B. Numerical designations on these equipotential lines give the percentage of the interelectrode voltage represented by each line with reference to 0 voltage at the grounded collecting electrode surface. Comparison of equipotential line distributions between the discharge electrodes and collecting electrodes clearly shows the improved field of the electrode of this invention. Since approximately 90% of the ellipsoidal electrode voltage exists across the same distance as 40% of the wire voltage, average voltage gradient of the ellipsoid is approximately twice that of the wires. This means that a charged particle in the zone of the ellipsoidal electrode is urged towards the collecting electrode with approximately twice the force.

Under actual operating conditions, space charge effects caused by corona generated ions and charged particulate improve distribution of the wire equipotential lines near the collecting plate. The inherent low corona current and the already uniform distribution of present electrode equipotential lines preclude much change by space charge. This causes the field difference between the improved electrode and wires to be less than twice.

It is expected that the improved electrode will be well suited for high resistivity coal ash in 12 inch or wider gas passages. Its low corona current combined with an edge treatment that forces uniform corona distribution along the electrode length are useful to prevent highly localized high corona current spots on the collecting electrode. This high current density causes back corona which ruins the electrical collecting fields in cold precipitators with high resistivity particulates.

Low corona characteristics of the ellipsoidal electrode may be of utility for hot precipitator applications and use with pulsed energization. In a hot precipitator, that is one operating above 550° F., the low corona characteristic of the electrode with straight edges may conserve power wasted in excessive gas ionization. In pulsed energization, the higher field strength of the electrode may prove useful for maintaining an improved or higher field strength in the system during the interpulse period.

The ellipsoidal "box type" support element of the preferred embodiment of this invention was discovered through a test of alternate rigid discharge electrode configurations. Its attributes include improvements in: structural rigidity, electrical field patterns, manufacturing procedures, aerodynamic gas flow, weight and cost. The alternate configurations of this electrode fail to provide all of the improvements found in the flattened ellipsoidal electrode.

Figures 11, 12, 13, 14, 15, 16:
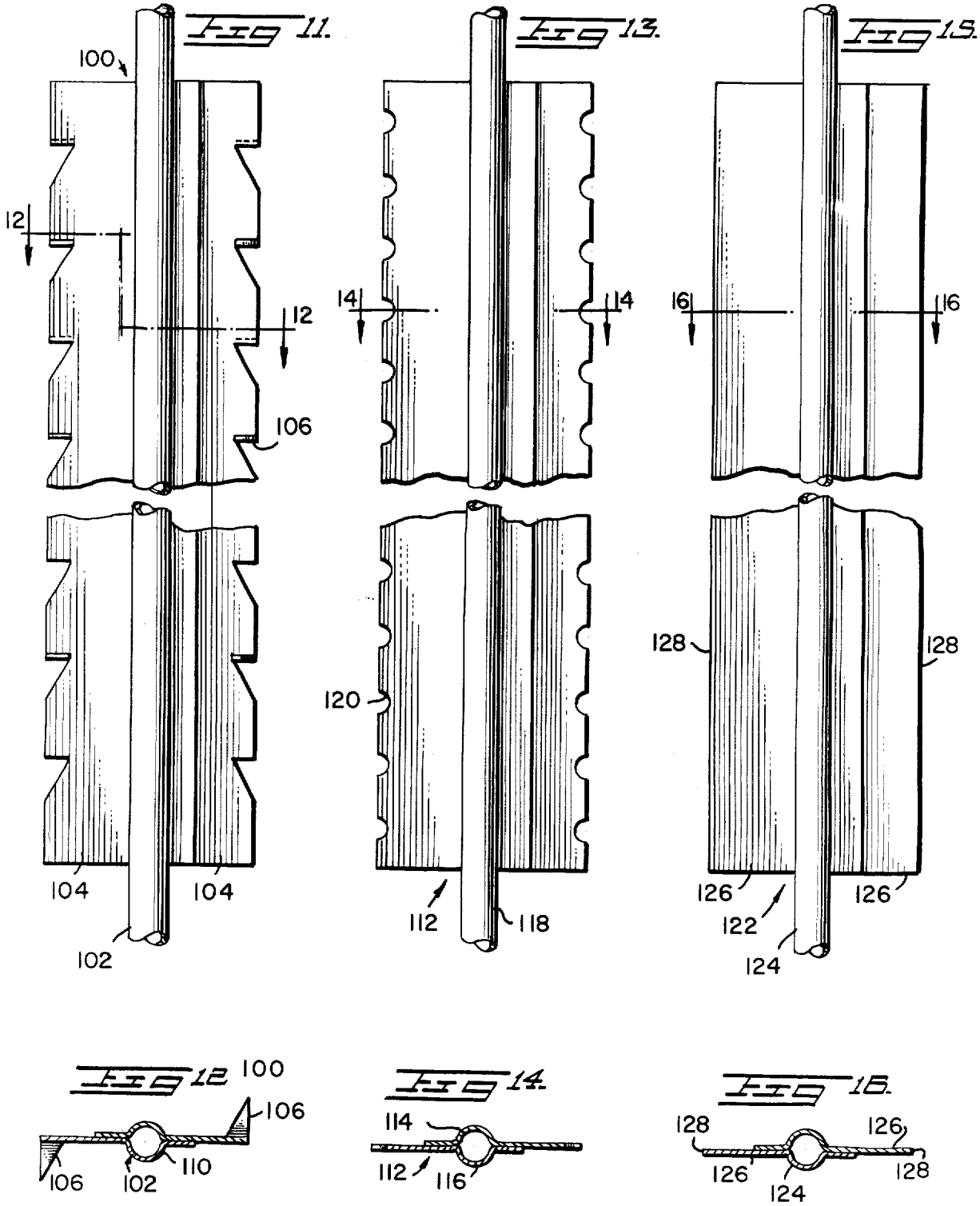
FIG. 11 is a view of another form of the improved discharge electrode.
FIG. 12 is a section on line 12—12 of FIG. 11.
FIG. 13 is a view of another form of the discharge electrodes of the invention.
FIG. 14 is a section on line 14—14 of FIG. 13.
FIG. 15 is a view of a generic form of the rigid discharge electrode of the invention.
FIG. 16 is a section on line 16—16 of FIG. 15.

One such alternate form is illustrated in FIGS. 11 and 12. There is illustrated a rigid electrode having pointed corona-producing elements rather than the notched form shown in FIGS. 6 through 10. In FIGS. 11 and 12, the electrode 100 consists of a support member 102 and wing elements 104. It will be particularly noted in FIG. 12 that the support portion 102 has a generally circular configuration in cross-section and that the pointed portions are formed by punching and bending triangular elements 106 alternately toward one side then toward the other, the pointed portions 106 being directed toward the opposed collecting plate electrodes. As in the prior form of the invention, the entire assembly is formed of two sheets 108 and 110, roll formed and then welded together. The electrode of FIGS. 11 and 12 would have terminal portions equivalent to the terminal portions previously described in reference to FIGS. 6 through 10.

In FIGS. 13 and 14, a modified form of notched rigid discharged electrode is illustrated and generally designated 112. The electrode 112 is formed of two sheets of metal 114 and 116 rolled to a configuration wherein the support portion 118 is generally cylindrical in cross-section and notches 120 of about one-half inch radius are formed along the leading and trailing edges of the electrode. After roll forming, the two portions 114 and 116 are welded together.

Figure 17:
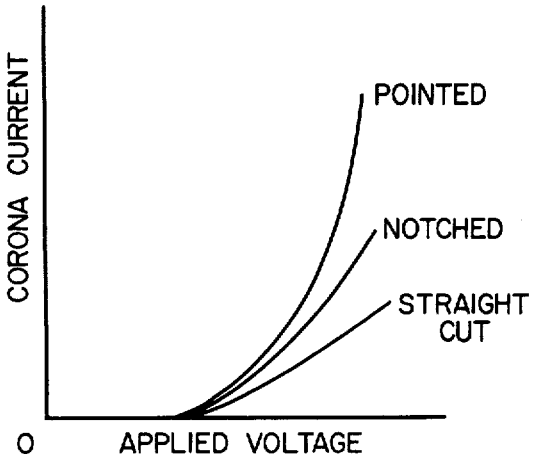
FIG. 17 is a chart of applied voltage against corona current for three of the forms of the rigid discharge electrode of the present invention.

In FIG. 17, a chart shows the corona current plotted against the applied voltage for the pointed-type electrode shown in FIGS. 11 and 12, the notched electrode shown in FIGS. 6 through 10 and 13 and 14 and the straight-cut electrode illustrated in FIGS. 15 and 16. With these three basic configurations, the engineer is able to select the proper form of edge effect to produce the necessary precipitating efficiency for various types of particle-laden gas streams.

Figure 18:
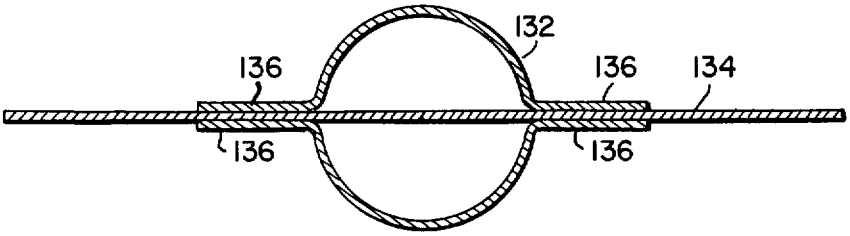
FIG. 18 is a section through one of the discharge electrodes of the present invention showing a method of assembly.

Referring now to FIG. 18, there is shown in section a further modified form of the present invention wherein the support member 132 is further rigidified by an assembly wherein the corona-producing member 134 passes completely through the support member 132 and is welded in such position by tabs 136. The edge configuration of the cross-plate 134 may be of the pointed, notched, or straight cut as dictated by the particular installation and, of course, this form of construction may be employed with the preferred form of box or support that is the flattened ellipsoidal form.

Figure 19:
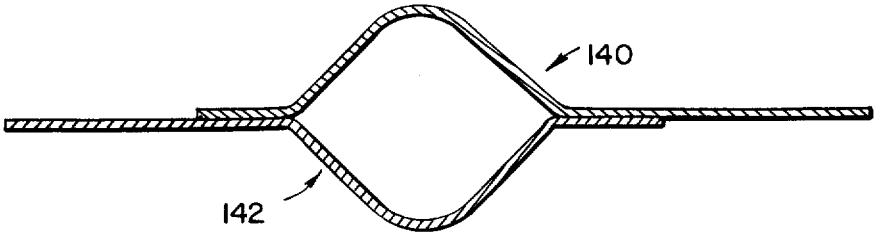
FIG. 19 is a section like that shown in FIG. 18 of a modified form of construction of the electrodes of the present invention.

In FIG. 19, there is illustrated a rigid electrode generally designated 140 of a construction similar to that illustrated in FIGS. 11 through 16 but for the cross-configuration of the primary support portion generally designated 142 which is of a rounded-box configuration in cross-section.

This configuration of the support portion 142 provides a modified corona voltage between the discharge electrode and its complementary collecting plates; however, this form is in general not as good as that illustrated in FIGS. 1-10.

Having thus described preferred and alternate embodiments of the present invention, it will be appreciated by those skilled in the art that various modifications may be made in the assemblages without departing from the scope of the present invention as defined in its appended claims.

We claim:

1. An electrostatic precipitator comprising a housing having a dirty gas inlet and a clean gas outlet, a plurality of spaced parallel extended surface collecting electrodes, spaced electrode rigidifying baffle elements extending vertically from top to bottom of said collecting electrodes, said baffle elements being further arranged in opposed manner to the baffles of opposed collecting electrodes, means rigidly supporting the collecting electrodes in the gas flow path through said housing, a discharge electrode system in the said housing in precipitating alignment to said collecting electrodes, said discharge electrode system comprising a horizontal top conductive beam rigidly connected to the precipitator high-tension frame, a plurality of rigid electrodes, each said electrode comprising a hollow support member, each said support member having a partially flattened ellipsoidal configuration in transverse cross section, corona members carried by the support member, said corona members projecting substantially along a plane passing through the long axis of each support member, said electrode and support member configuration serve to prevent highly localized high corona current spots on said collecting electrodes, and at least an upper termination member secured in the upper end of the hollow support member, means connecting the upper termination member to the said top conductive beam, a lower discharge electrode support frame underlying the rigid discharge electrodes and substantially transversely co-extensive with said rigid discharge electrodes, means connecting each lower end of the hollow support members of each said rigid discharge electrodes to the lower discharge support frame.

2. The invention defined in claim 1 wherein the corona members carried by the support member have notches in the vertical edges thereof.

3. The invention defined in claim 1 wherein the corona members carried by the support member have points formed along the vertical edges of the members.

4. The invention defined in claim 1 wherein the vertical edges of the corona members are straight cut.

5. The invention defined in claim 1 wherein the hollow support member and the corona members are formed from roll-formed sheets welded together.

6. The invention defined in claim 5 wherein the corona-producing members pass through the hollow support members.

7. The invention defined in claim 1 wherein the rigid discharge electrodes have upper and lower terminal portions which are pin connected to the upper and lower frames.

* * * * *